US011368787B1

(12) United States Patent
Paddock

(10) Patent No.: US 11,368,787 B1
(45) Date of Patent: Jun. 21, 2022

(54) SPEAKER SYSTEMS INCLUDING FORWARD AND BACKWARD FACING PASSIVE RADIATORS

(71) Applicant: Sound Edge LLC, Monterey, CA (US)

(72) Inventor: Thomas L Paddock, Truckee, CA (US)

(73) Assignee: Sound Edge LLC, Monterey, CA (US)

( * ) Notice: Subject to any disclaimer, the term of this patent is extended or adjusted under 35 U.S.C. 154(b) by 0 days.

(21) Appl. No.: 16/544,569

(22) Filed: Aug. 19, 2019

Related U.S. Application Data

(60) Provisional application No. 62/719,548, filed on Aug. 17, 2018.

(51) Int. Cl.
*H04R 1/28* (2006.01)
*H04R 1/26* (2006.01)
*H04R 1/02* (2006.01)

(52) U.S. Cl.
CPC ..... *H04R 1/2834* (2013.01); *H04R 1/025* (2013.01); *H04R 1/26* (2013.01)

(58) Field of Classification Search
CPC combination set(s) only.
See application file for complete search history.

(56) References Cited

U.S. PATENT DOCUMENTS 1,988,250 A * 1/1935 Olson ..... H04R 1/2834 381/184
3,780,824 A * 12/1973 Prince ..... H04R 1/2834 181/144
5,629,502 A * 5/1997 Nakano ..... H04R 1/2842 181/156
6,169,811 B1 * 1/2001 Croft, III ..... H04R 1/2842 181/144
2004/0105565 A1 * 6/2004 Butters ..... H04R 1/2834 381/347
2010/0135516 A1 * 6/2010 Saiki ..... H04R 1/2811 381/386
2012/0114148 A1 * 5/2012 Goh Kong San .... H04R 1/2834 381/186
2014/0193005 A1 * 7/2014 Riggs ..... H04R 5/02 381/300
2016/0219362 A1 * 7/2016 Litovsky ..... H04R 1/2834
2017/0111605 A1 * 4/2017 Zheng ..... H04N 5/642
2018/0146281 A1 * 5/2018 Spero ..... H04R 1/025

* cited by examiner

*Primary Examiner* — Angelica M McKinney
(74) *Attorney, Agent, or Firm* — Edward B. Weller

(57) ABSTRACT

A speaker system comprises a first speaker subsystem comprising a first active driver and a first passive radiator that is forward facing; and a second speaker subsystem comprising a second active driver and a second passive radiator that is backward facing. The first speaker subsystem has a corner frequency that is a first predetermined harmonic of the resonance frequency of the first passive radiator, and the first active driver has a resonance frequency that is a second predetermined harmonic of the resonance frequency of the first passive radiator. The second speaker subsystem has a corner frequency that is the first predetermined harmonic of the resonance frequency of the second passive radiator, and the second active driver has a resonance frequency that is the second predetermined harmonic of the resonance frequency of the second passive radiator.

4 Claims, 4 Drawing Sheets

400

SPEAKER SYSTEMS INCLUDING FORWARD AND BACKWARD FACING PASSIVE RADIATORS

RELATED APPLICATIONS

This application claims the benefit under 35 USC § 119 to U.S. Provisional Patent Application Ser. No. 62/719,548 filed on Aug. 17, 2018, which is incorporated by reference herein in its entirety.

FIELD

The disclosure relates to sound systems, and more particularly, to sound systems with passive radiators.

BACKGROUND

Speaker systems include active transducers or drivers to generate sound. The active driver is housed in speaker cabinets that control the sound waves generated behind the driver.

SUMMARY

The present disclosure provides a speaker system that comprises a first speaker subsystem comprising a first active driver and a first passive radiator that is forward facing. The first speaker subsystem has a corner frequency that is a first predetermined harmonic of the resonance frequency of the first passive radiator. The first active driver has a resonance frequency that is a second predetermined harmonic of the resonance frequency of the first passive radiator.

In one embodiment, the first predetermined harmonic is a second harmonic and the second predetermined harmonic is a third harmonic.

In one embodiment, the first predetermined harmonic is a second harmonic and the second predetermined harmonic is a fifth harmonic.

In one embodiment, the speaker system further comprises a second speaker subsystem comprising a second active driver and a second passive radiator that is backward facing. The second speaker subsystems has a corner frequency that is the first predetermined harmonic of the resonance frequency of the second passive radiator, the second active driver has a resonance frequency that is the second predetermined harmonic of the resonance frequency of the second passive radiator.

The present disclosure also provides a speaker system comprising a first speaker subsystem comprising a first active driver and a first passive radiator that is forward facing; and a second speaker subsystem comprising a second active driver and a second passive radiator that is backward facing. A sound field generated by the first speaker subsystem is a forward facing hemisphere. A sound field generated by the second speaker subsystems is a backward facing hemisphere.

In one embodiment, the first speaker subsystem has a corner frequency that is a first predetermined harmonic of the resonance frequency of the first passive radiator, and the first active driver has a resonance frequency that is a second predetermined harmonic of the resonance frequency of the first passive radiator. The second speaker subsystems has a corner frequency that is the first predetermined harmonic of the resonance frequency of the second passive radiator, and the second active driver has a resonance frequency that is the second predetermined harmonic of the resonance frequency of the second passive radiator.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

BRIEF DESCRIPTION OF THE DRAWINGS

With respect to the discussion to follow and in particular to the drawings, it is stressed that the particulars shown represent examples for purposes of illustrative discussion, and are presented in the cause of providing a description of principles and conceptual aspects of the present disclosure. In this regard, no attempt is made to show implementation details beyond what is needed for a fundamental understanding of the present disclosure. The discussion to follow, in conjunction with the drawings, make apparent to those of skill in the art how embodiments in accordance with the present disclosure may be practiced. In the accompanying drawings.

DETAILED DESCRIPTION

Various embodiments of the present invention are now described with reference to the figures where like reference numbers indicate identical or functionally similar elements. Also in the figures, the left most digits of each reference number corresponds to the figure in which the reference number is first used.

The present disclosure provides a sound system that includes a low frequency array (LOFAR) of active drivers and passive radiators. The audio infrastructure network may include a multiple element, high excursion, high power, high density, low frequency transducer array to create bass audio from smaller speaker transducers eliminating the need for a external subwoofer speaker and bass audio that is particularly suited for, but not limited to, computer games or music soundtracks with deep bass frequency spectra including synthesizers, drums, seismological and gaming battlefield simulations.

Figure 1:
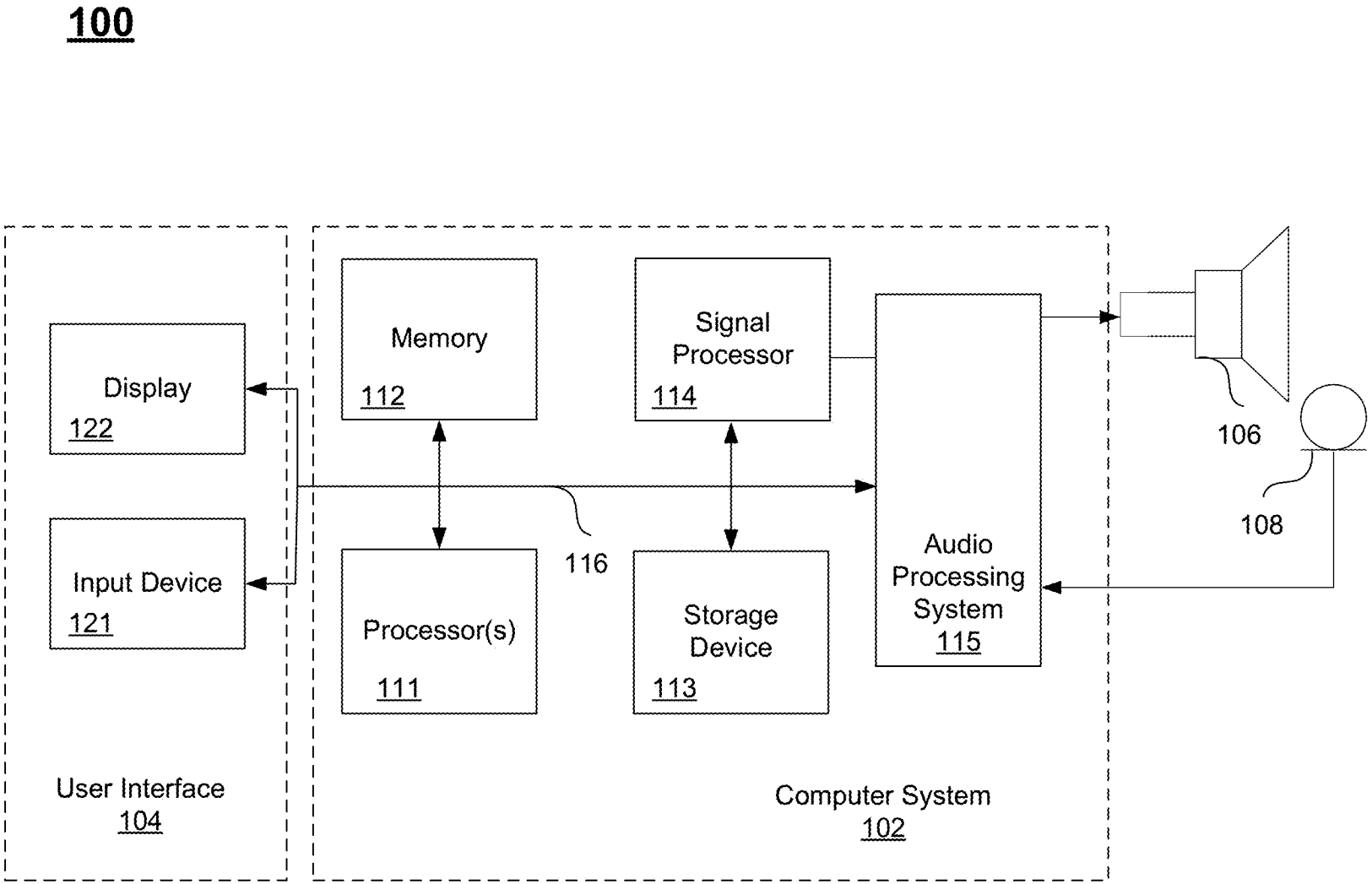
FIG. 1 is a block diagram illustrating a sound system according to some embodiments.

FIG. 1 is a block diagram illustrating a sound system 100 according to some embodiments. Sound system 100 comprises a computer system 102, a user interface 104, and a speaker system 106. In some embodiments, sound system 100 comprises a microphone and/or an accelerometer 108.

Computer system 102 generates audio signals that are reproduced by speaker system 106. Computer system 102 performs digital signal processing on the audio signals to adjust the frequency response, lower distortion, or adjust amplification or all of the above of the audio signal and generate a calculated frequency response, distortion reduction profile or amplification, which in some embodiments, is based on sound from speaker system 106 detected and provided as feedback by microphone or accelerometer or both 108, and in response to user input received from user interface 104.

Computer system 102 comprises one or more processors 111, one or more memories 112, one or more storage devices 113, one or more signal processors 114, one or more audio processing systems 115, and a communication network 116, such as a bus.

Communication network 116 communicates information between user interface 104, processor 111, memory 112, storage device 113, signal processor 114, and audio processing system 115 for processing and storing information. Memory 112 stores information and instructions to be executed by processor 111, including information and instructions for performing the techniques described herein. Memory 112 stores variables or other intermediate information during execution of instructions to be executed by processor 111. Possible implementations of memory 112 may be, but are not limited to, random access memory (RAM), read only memory (ROM), or both. A computer or machine readable storage device 113 stores information and instructions. Storage device 113 may include source code, binary code, or multiple-time window files for performing the techniques herein, for example. Storage device 113 and memory 112 are both examples of computer readable mediums.

User interface 104 is a user or other interface that includes one or more data input/output devices for communicating with a human user or with another system, such as computer system 102, to input/output data. User interface 104 comprises an input device 121 and a display 122 that are each coupled to communication network 116.

Signal processor 114 generates and filters audio signals that are provided to audio processing system 115 for reproduction by speaker system 106. In some embodiments, signal processor 114 executes the digital signal processing of a main processing loop process for multiple-time window crest factor enhancing amplification, peak limiting, long term root mean square (RMS) limiting, short term RMS limiting, and clipping of the audio signal.

In various embodiments, signal processor 114 performs digital signal processing on the audio signals for filtering, frequency response shaping, equalization or amplification of the audio signal. In some embodiments, signal processor 114 generates a calculated frequency response based on feedback from speaker system 106 as detected by microphone 108 and in response to user input received from user interface 104.

In one embodiment, signal processor 114 receives the audio signal as a pulse-code modulation (PCM) signal. In one embodiment, signal processor 114 receives the audio signal as an uncompressed audio signal.

Signal processor 114 provides the calibrated audio signal to audio processing system 115 as a PCM signal. In some embodiments, audio processing system 115 converts the PCM signal to a pulse-width modulation (PWM) signal or an analog signal prior to amplifying the signal.

In one embodiment, signal processor 114 is implemented as a tool modified code in the operating system of processor 111. In one embodiment, signal processor 114 is implemented as an embedded system in a chip set or gate array.

Audio processing system 115 converts the digital audio signal from signal processor 114 to an analog signal amplifies the signal, and provides the amplified signal to speaker 106. In some embodiments, audio processing system 115 receives an audio signal from microphone 108, converts the signal into a digital signal, and provides the signal to audio processing system 115. Audio processing system 115 comprises analog-to-digital converters, amplifiers, drivers, and crossover networks.

In various embodiments, microphone 108 is disposed external to and in near field or very near field of speaker 106. Microphone 108 captures the sound from speaker 106, and provides the captured sound data to audio processing system 115. Audio processing system 115 processes the analog captured data, converts the captured data to digital, and provides the converted digital data to signal processor 114. Microphone 108 may be used to determine sound pressure levels (SPL) in the room so that signal processor 114 may adjust the applied processing based on the captured sound. In some embodiments, accelerometer 108 captures the movement of the passive radiator 228 or 230 or both. In some embodiments, the accelerometer 108 is disposed on the speaker subsystem 106.

Input device 121 is a user or other interface that includes one or more data input devices for communicating with a human user or with another system to input data. In various embodiments, input device 121 is a keyboard, mouse and/or touch screen.

Display 122 is a user or other interface that includes one or more data output devices for communicating with a human user or with another system to output data. In various embodiments, display 122 includes a presentation system, one or more multiple-time window applications, or one or more data communication gateways.

Speaker system 106 generates sound in response to an audio signal from audio processing system 115. In the following description, the term "speaker system" is used interchangeably with "speaker". In various embodiments, speaker 106 includes one or more sub-woofers, one or more woofers, one or more midranges, or one or more tweeters, or any combination thereof. Speaker 106 may be housed in one or more cabinets or enclosures. In various embodiments, speaker 106 includes electronics, such as a crossover network.

Speaker system 100 may be, for example, the sound bars described below in conjunction with FIG. 2 or the speakers described below in conjunction with FIGS. 3 and 4.

Although audio processing system 115 is shown as part of computer system 102, audio processing system 115 may be external to computer system 102, and may be part of speaker 106. Audio processing system 115 may be wirelessly coupled to computer system 102.

Figure 2:
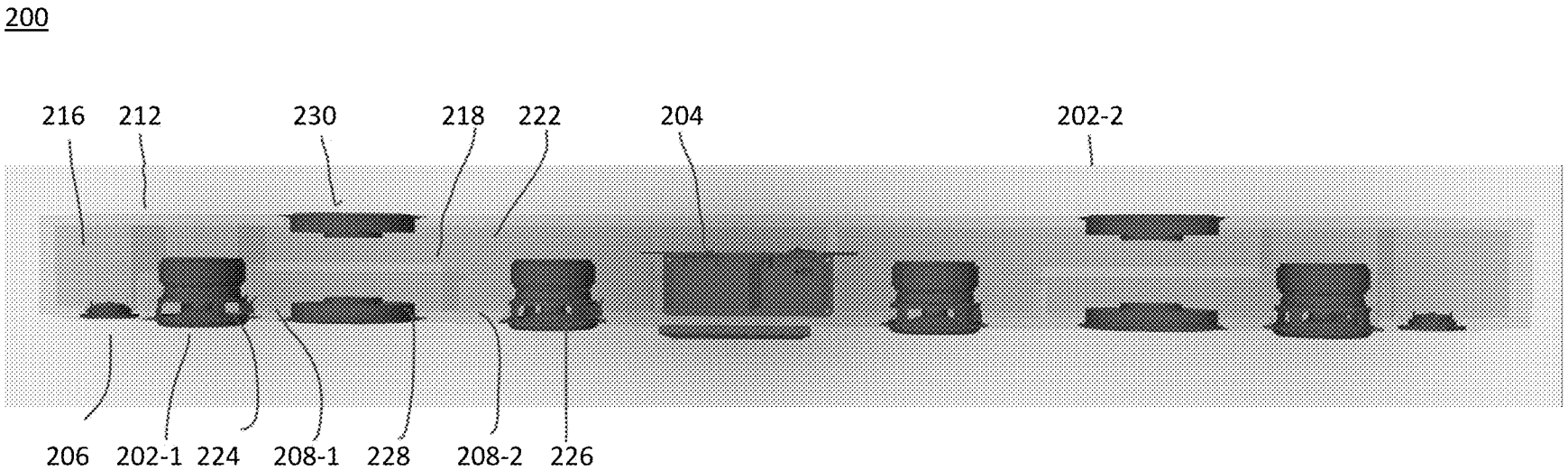
FIG. 2 is a transverse cross-sectional view of a sound bar according to some embodiments.

FIG. 2 is a transverse cross-sectional view of a sound bar 200 according to some embodiments. Sound bar 200 comprises a left speaker subsystem 202-1, a right speaker subsystem 202-2, and an electronics system 204. Right speaker subsystem 202-2 is a mirror image of the left speaker subsystem 202-1. Reference numerals are not shown for right speaker subsystem 202-2 for the sake of simplicity and clarity. In some embodiments, right speaker subsystem 202-2 is arranged in a similar manner as, and is not a mirror image of, the left speaker subsystem 202-1. Speaker subsystem 202 comprises a tweeter 206 and a pair of subwoofers 208-1 and 208-2. In some embodiments, speaker subsystem 202 does not include a tweeter 206. Speaker subsystem 202 may include other active speakers, such as midrange speakers in addition to or instead of tweeter 206. In various embodiments, speaker subsystem 202 includes other numbers of subwoofers 208-1 and 208-2.

Speaker system 106 provides high-fidelity gaming or compressed or uncompressed movie soundtrack audio or music. Using two speaker subsystems 202 provides left and right stereo with four subwoofers that eliminates the need for bass crossover and mixer which can create bass drop-outs and eliminates the need for an external "0.1" sub-woofer bass speaker, which can induce time distortion and can degrade stereo imaging distortion.

Video games generate low frequency sounds, such as low frequency events, explosions and gaming gunfire simulations. In various embodiments, speaker system 106 reduces or eliminates subwoofer-generated display vibration that increases gaming display accuracy, color balance and linearity, benefits a gamer's battlefield imaging "focus", and reduces gamer fatigue. Speaker subsystem 202 comprises an enclosure 212 that forms a speaker cabinet. Although enclosure 212 is shown as a rectangular box shape, enclosure 212 may be formed in other shapes. Some or all walls of enclosure 212 may be perpendicular or at other angles to each other. Some or all corners of the enclosure 212 may be rounded. Some or all walls of enclosure 212 may have flat surfaces. Enclosure 212 may be formed of wood, such as medium density fibreboard, plastic, or other high mass, non-resonant material. Enclosure 212 reduces speaker enclosure resonance which allows for the manufacture of low cost, low mass plastic speaker enclosures and eliminates the need for costly high-mass medium density fiberboard for speaker enclosure construction. LOFAR technology mitigates enclosure resonance effects to such an extent that thinner, less rigid enclosure structures can be utilized without compromising speaker acoustics.

Speaker subsystem 202 further comprises a baffle 214 that forms a chamber 216 in the tweeter 206, and a baffle 218 that forms a chamber 220 in subwoofer 208-1 and a chamber 222 in subwoofer 208-2.

In some embodiments, the baffle 218 is L-shaped. In other embodiments, the baffle 218 is curved, such as S-shaped. In various embodiments, a curved baffle 218 provides better sound for voice than an L-shaped or an S-shaped baffle 218; however, an L-shaped baffle or an S-shaped baffle 218 may be less expensive to make. In some embodiments, speaker subsystem 208-1 or 208-2 do not include a baffle 218.

Subwoofer 208-1 comprises an active driver 224 and a passive radiator 228 that are disposed in a front wall of the enclosure. Subwoofer 208-2 comprises an active driver 226 that is disposed in a front wall of enclosure 212 and a passive radiator 228 that is disposed in a back wall of enclosure 212. The central axes of active drivers 224 and 226 are perpendicular to the front wall of enclosure 212. Passive radiators 228 and 230 radiate sound outwardly from enclosure 212. In some embodiments, the central axes of the passive radiators 228 and 230 are perpendicular to the front and back walls, respectively, of enclosure 212. In some embodiments, the central axes of passive radiators 228 and 230 are aligned.

In some embodiments in which speaker subsystem 202 lacks a baffle 218 passive radiator 230 is mounted opposite passive radiator 228 so that passive radiator 228 forms a mechanical opposing radiator and is a physical mirror image of passive radiator 230.

In various embodiments, passive radiators 228 and 230 are mounted opposite and parallel to each other so that the passive radiators form mechanical opposing radiators and that are physical mirror images of each other. Passive radiators 228 and 230 being parallel to each other may reduce vibration and have flatter bass. Angling passive radiators 228 and 230 to each other may flatten the power spectra and may increase the vibration energy in the enclosure 212. In various embodiments, the passive radiators might be included on 3 or more sides of a triangular- or cuboid-shaped enclosure, so long as they are balanced around a radius and an equal distance from a center line. The power spectra may be flattened in the bass range depending on the angle and active drivers 224 and 226 and enclosure 212.

The overtone of the frequency of passive radiators 228 and 230 enhances the bass response of sound bar 200. In some embodiments, the sound has more thickness and fullness In some embodiments, speaker subsystem 202 does not include a passive radiator 228.

Figure 3:
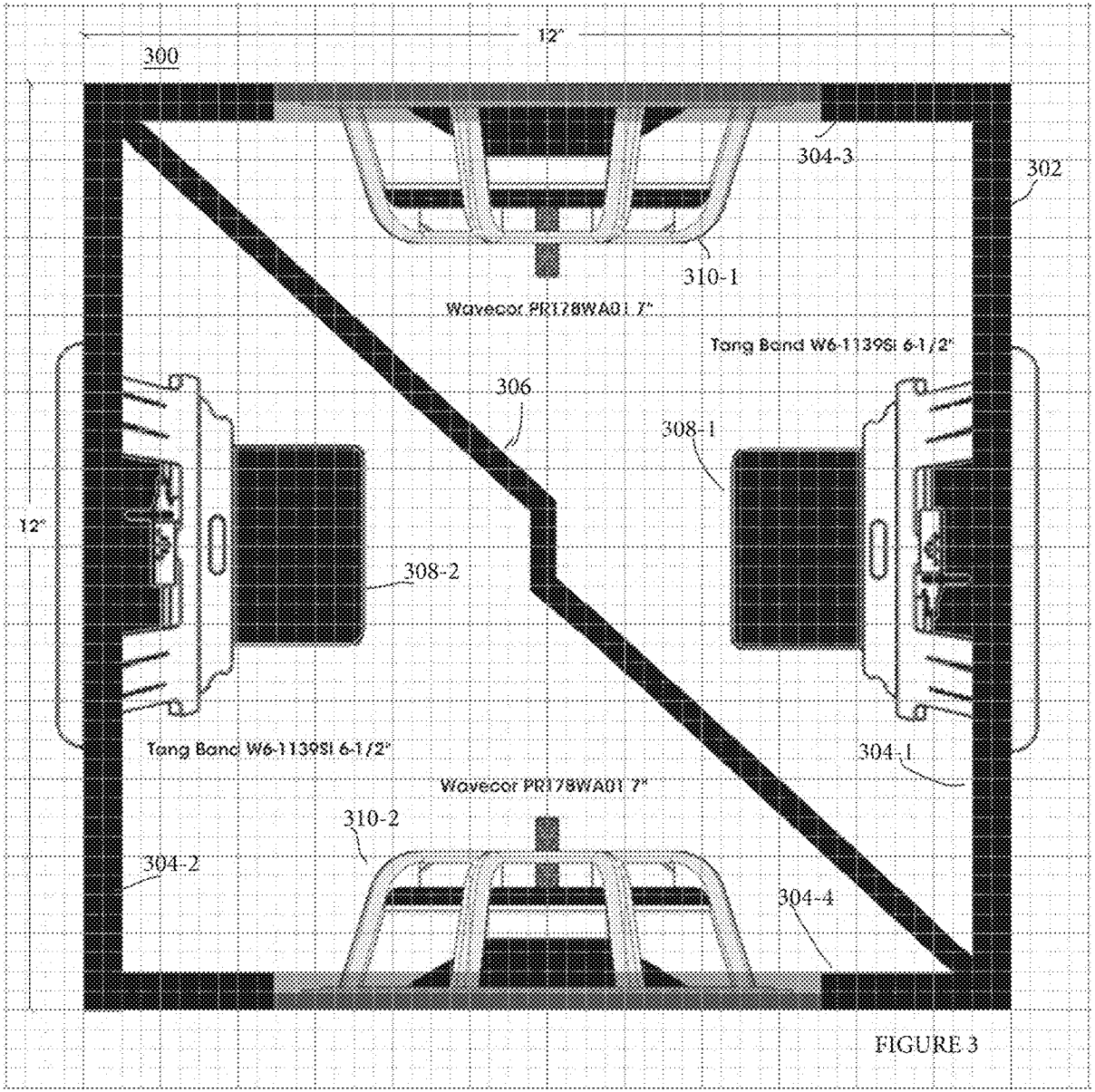
FIG. 3 is a transverse cross-sectional view of a speaker according to some embodiments.

FIG. 3 is a transverse cross-sectional view of a speaker 300 according to some embodiments. Speaker 300 comprises an enclosure 302 that forms a speaker cabinet.

Enclosure 302 may be formed in a similar manner as enclosure 212 described above. Enclosure 302 is formed of four walls wherein a first wall 304-1 is opposite a second wall 304-2, and a third wall 304-3 is opposite a fourth wall 304-4. Enclosure 302 may include a baffle 306 to separate the enclosure 302 into two chambers. Sub-woofers 308-1 and 308-2 are mounted in walls 304-1 and 304-2, respectively. Passive radiators 310-1 and 310-2 are mounted in walls 304-3 and 304-4, respectively.

Figure 4:
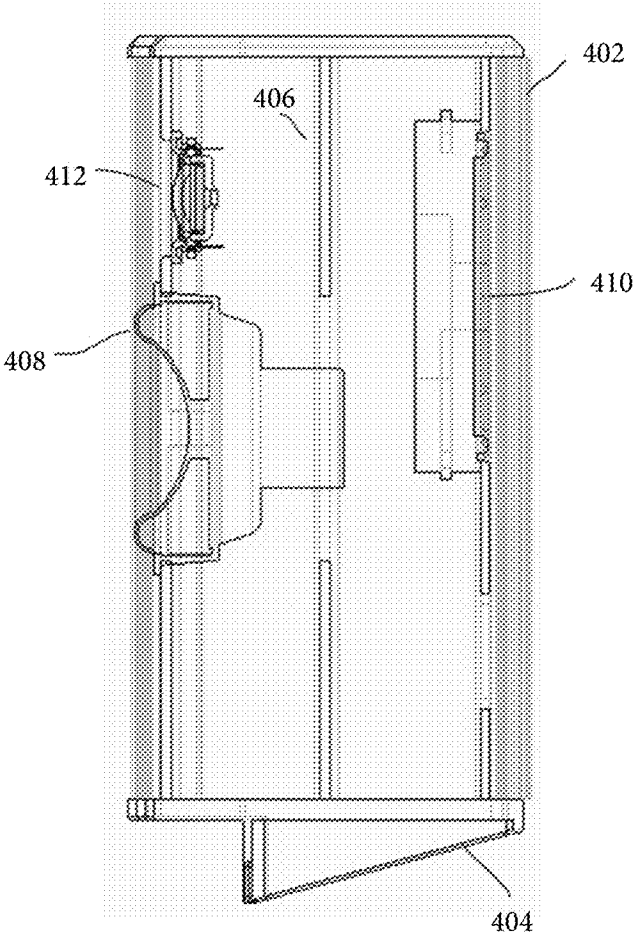
FIG. 4 is a transverse cross-sectional view of a speaker according to some embodiments.

FIG. 4 is a transverse cross-sectional view of a speaker 400 according to some embodiments. Speaker 400 comprises an enclosure 402 that forms a speaker cabinet disposed on a base 404. The base 404 may be triangular in shape to direct sound upward. Enclosure 402 may be formed in a similar manner as enclosure 212 described above. Enclosure 402 may include a baffle 406 to separate the enclosure 402 into two chambers.

A sub-woofer 408 and a tweeter 412 are disposed in a front wall of enclosure 402. In some embodiments, speaker 400 does not include a tweeter 412. Speaker 400 may include other active speakers, such as midrange speakers in addition to or instead of tweeter 412. A passive radiator is disposed in a back wall of enclosure 402, and may be offset from sub-woofer 408, or may be opposite sub-woofer 408.

In some embodiments, the corner frequency of the speaker is a harmonic of the passive radiator and the frequency of the active speaker is a harmonic of the passive radiator. This embodiment provides an enhanced reinforced fundamental of the sound system 100.

In some embodiments, the corner frequency of the speaker is a second harmonic of the passive radiator and the frequency of the active speaker is a third harmonic of the passive radiator.

In one embodiment, the frequency (Fpr) of the passive radiator is in a range of 28 to 32 Hz, the corner frequency (Fo) of the speaker is at a second harmonic of Fp, and the resonant frequency (Fs) of the active speaker is at a third harmonic of Fpr.

In one embodiment, the frequency (Fpr) of the passive radiator is in a range of 28 to 32 Hz (Fpr), the corner frequency of the speaker is in a range of 56 to 64 Hz (Fo), and the resonant frequency (Fs) of the active speaker is in a range of 84 to 96 Hz.

In one embodiment, the frequency (Fpr) of the passive radiator is 30 Hz (Fpr), the corner frequency of the speaker is 60 Hz (Fo), and the resonant frequency (Fs) of the active speaker is 90 Hz.

In one embodiment, the frequency (Fpr) of the passive radiator is in a range of 37 to 40 Hz (Fpr), the corner frequency of the speaker is in a range of 74 to 80 Hz (Fo), and the resonant frequency (Fs) of the active speaker is in a range of 111 to 120 Hz.

In one embodiment, the frequency (Fpr) of the passive radiator is 38 Hz (Fpr), the corner frequency of the speaker is 76 Hz (Fo), and the resonant frequency (Fs) of the active speaker is 114 Hz.

In one embodiment, the frequency (Fpr) of the passive radiator is in a range of 48 to 52 Hz, the corner frequency (Fo) of the speaker is at a second harmonic of Fp.

In one embodiment, the frequency (Fpr) of the passive radiator is in a range of 48 to 52 Hz (Fpr), the corner frequency of the speaker is in a range of 96 to 104 Hz (Fo), and the resonant frequency (Fs) of the active speaker is in a range of 144 to 156 Hz.

In one embodiment, the frequency (Fpr) of the passive radiator is 50 Hz (Fpr), the corner frequency of the speaker is 100 Hz (Fo), and the frequency of the active speaker is 150 Hz (Fs).

In one embodiment, the frequency (Fpr) of the passive radiator is in a range of 58 to 62 Hz, the corner frequency (Fo) of the speaker is at a second harmonic of Fp, and the resonant frequency (Fs) of the active speaker is at a third harmonic of Fpr.

In one embodiment, the frequency (Fpr) of the passive radiator is in a range of 58 to 62 Hz (Fpr), the corner frequency of the speaker is in a range of 116 to 124 Hz (Fo), and the resonant frequency (Fs) of the active speaker is in a range of 174 to 186 Hz.

In one embodiment, the frequency (Fpr) of the passive radiator is 60 Hz (Fpr), the corner frequency of the speaker is 120 Hz (Fo), and the frequency of the active speaker is 180 Hz (Fs).

In one embodiment, the frequency (Fpr) of the passive radiator is less than 65 Hz, the corner frequency of the speaker is less than 130 Hz (Fo), and the frequency of the active speaker is less than 195 Hz (Fs).

In some embodiments, the frequency (Fpr) of the passive radiator is a harmonic of a first frequency (Fret), the corner frequency (Fo) of the speaker is a harmonic of the first frequency (Fref) and, in in one embodiment is a harmonic that is one greater than the harmonic of the passive radiator, and the frequency (Fs) of the active speaker is a harmonic of the first frequency (Fref), and in one embodiment, is a harmonic that is two above the harmonic of the passive radiator. For example, the first frequency (Fret) is 15 Hz, the passive radiator resonant frequency (Fpr) is 30 Hz, the corner frequency (fo) of the speaker is 45 Hz, and the frequency (Fs) of the active speaker is 60 Hz.

In some embodiments, signal processor 114 provides equalization to boost or cut the resonant characteristics at the corner frequency (Fo), the passive radiator resonant frequency (Fpr) or at the active speaker frequency (Fs).

In some embodiments, speaker system 106 comprises a sound bar that includes a plurality of forward-facing passive radiators and a plurality of backward-facing passive radiators. The plurality of forward-facing passive radiators forms a front hemispherical bass sound field. The plurality of backward-facing passive radiators forms a back hemispherical bass sound field. The combination of the hemispherical bass sound fields from the forward-facing passive radiators and the backward-facing sound fields forms a more perfect, better defined and more efficient spherical bass sound field emanating from the enclosure.

In some embodiments, the plurality of forward-facing passive radiators and the plurality of backward-facing passive radiators are aligned for left and right stereo. This may provide enhanced dynamic impact of the bass and perceived sound field.

In some embodiments, the plurality of forward-facing passive radiators and the plurality of backward-facing passive radiators are offset for left and right stereo. The sound is worse with the offset.

Subsystems 202 can be added together to form multiple channels. Five four speaker modules can be formed to create a five speaker system. The computer system 102 provides low-frequency effects (LFE) into each subsystem 202. An audio 2.2 system may be formed with two speaker modules.

Reference in the specification to "one embodiment", "an embodiment", "various embodiments" or "some embodiments" means that a particular feature, structure, or characteristic described in connection with these embodiments is included in at least one embodiment of the invention, and such references in various places in the specification are not necessarily all referring to the same embodiment.

The use of the terms "top", "bottom", "left" and "right" are for convenience and are not to be construed as limiting.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise. Also, as used in the description herein and throughout the claims that follow, the meaning of "on" includes "in" and "on" unless the context clearly dictates otherwise.

While particular embodiments and applications of the present invention have been illustrated and described herein, it is to be understood that the invention is not limited to the precise construction and components disclosed herein and that various modifications, changes, and variations may be made in the arrangement, operation, and details of the methods and apparatuses of the present invention without departing from the spirit and scope of the invention as it is defined in the appended claims.

What is claimed is:

1. A speaker system comprising:

a first speaker subsystem comprising a first active driver that is forward facing and a first passive radiator that is forward facing; and wherein the first speaker subsystem has a corner frequency that is a first predetermined harmonic of the resonance frequency of the first passive radiator, the first active driver has a resonance frequency that is a second predetermined harmonic of the resonance frequency of the first passive radiator.

2. The speaker system of claim 1, wherein the first predetermined harmonic is a second harmonic of the resonance frequency of the first passive radiator and the second predetermined harmonic is a third harmonic of the resonance frequency of the first passive radiator.

3. The speaker system of claim 1, wherein the first predetermined harmonic is a second harmonic of the resonance frequency of the first passive radiator and the second predetermined harmonic is a fifth harmonic of the resonance frequency of the first passive radiator.

4. The speaker system of claim 1, further comprising:

a second speaker subsystem comprising a second active driver that is forward facing and a second passive radiator that is backward facing, wherein the second speaker subsystems has a corner frequency that is the first predetermined harmonic of the resonance frequency of the second passive radiator, the second active driver has a resonance frequency that is the second predetermined harmonic of the resonance frequency of the second passive radiator.

* * * * *